US006536733B1

(12) United States Patent
Sharp

(10) Patent No.: US 6,536,733 B1
(45) Date of Patent: Mar. 25, 2003

(54) COOLER WITH INTEGRATED UMBRELLA STAND

(76) Inventor: John R. Sharp, 2515 Mark W. Station Rd., Windsor, CA (US) 95492

( * ) Notice: Subject to any disclaimer, the term of this patent is extended or adjusted under 35 U.S.C. 154(b) by 0 days.

(21) Appl. No.: 09/632,362

(22) Filed: Aug. 3, 2000

(51) Int. Cl.[7] ..... F16M 13/00
(52) U.S. Cl. ..... 248/519; 248/539; 62/457.7
(58) Field of Search ..... 248/511, 513, 248/514, 535, 539, 519, 110, 311.2, 528, 74.1, 207; 135/16; 62/457.7, 331; 211/65, 70.6, 87, 68

(56) References Cited

U.S. PATENT DOCUMENTS

| | | | | | |
|---|---|---|---|---|---|
| 562,566 | A | | 6/1896 | Baynes | |
| 1,079,192 | A | * | 11/1913 | Sowden | 248/311 |
| 1,404,477 | A | | 1/1922 | Pattberg et al. | |
| 2,502,103 | A | | 3/1950 | Puls | 135/7.1 |
| D190,778 | S | | 6/1961 | Brooks | D67/4 |
| 3,051,422 | A | * | 8/1962 | Crump et al. | 248/40 |
| 4,014,128 | A | * | 3/1977 | Hrdicka | 43/21.2 |
| 4,234,154 | A | * | 11/1980 | Walters et al. | 248/539 |
| 4,704,875 | A | * | 11/1987 | Kieler | 62/372 |
| 4,747,490 | A | | 5/1988 | Smith | 206/542 |
| 4,749,160 | A | | 6/1988 | Shih | 248/316.1 |
| 4,974,426 | A | * | 12/1990 | Gomez et al. | 62/457.7 |
| D318,391 | S | | 7/1991 | Greenhut et al. | D6/554 |
| 5,139,375 | A | * | 8/1992 | Franchuk | 410/105 |
| 5,234,143 | A | * | 8/1993 | Mahvi et al. | 224/31 |
| 5,269,157 | A | * | 12/1993 | Ciminelli et al. | 62/457.7 |
| D351,533 | S | | 10/1994 | Lynam | D7/605 |
| 5,452,877 | A | | 9/1995 | Riffle et al. | 248/511 |
| 5,477,964 | A | | 12/1995 | Hart | 206/349 |
| 5,599,037 | A | * | 2/1997 | Spickler | 280/652 |
| 5,934,499 | A | | 8/1999 | van der Hoven | 220/475 |
| 6,193,201 | B1 | * | 2/2001 | Babcock | 248/311.2 |
| 6,216,488 | B1 | * | 4/2001 | Rucker | 62/457.7 |
| 2001/0013358 | A1 | * | 8/2001 | Patarra | 135/16 |

FOREIGN PATENT DOCUMENTS

| | | | | |
|---|---|---|---|---|
| FR | 2678977 | * | 7/1991 | 15/58 |

* cited by examiner

*Primary Examiner*—Ramon O. Ramirez
*Assistant Examiner*—A. Joseph Wujciak, III

(57) ABSTRACT

A cooler (ice chest) with an integrated umbrella stand. A cooler serves as the base of an umbrella stand. A receptacle for the umbrella pole is provided on a side of the cooler. In one embodiment, the receptacle includes two hinged rings. In another embodiment, the receptacle is molded into a recess in the side of the cooler. In an alternative embodiment, a conventional cooler is converted to an umbrella stand by applying hinged rings to the side of the cooler. In a preferred embodiment, the hinged rings are die-cut from a sheet of material as a single piece and attached to the cooler with an adhesive.

10 Claims, 5 Drawing Sheets

COOLER WITH INTEGRATED UMBRELLA STAND

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

The invention relates generally to umbrella stands, and more specifically to a cooler or "ice chest" with a receptacle for receiving an umbrella pole to support an umbrella.

Umbrellas are often used for shade, such as at a beach or park. The shade provided by an umbrella is desirable for several reasons, such as relief from the heat, or to avoid becoming sunburned. Beach umbrellas are typically fairly large, and can be difficult to anchor in some situations. Particularly, some beaches may be rocky or be of heavy gravel, and not allow easy insertion of the umbrella pole into the soil. Similarly, it may be desirable to provide shade on a lawn, where it would be difficult and possibly inappropriate to drive an umbrella pole into the lawn.

One solution to providing support for a shade umbrella is a heavy base, such as are commonly known as a flag stand. Such supports are often seen in outdoor café's, for example, and usually have a large concrete, iron, or other heavy base with a socket in the center to accept the umbrella pole. Often, the bases are circular to allow them to be rolled to the desired location because they are so heavy and awkward to carry. However, it is impractical for an individual to carry such a stand any appreciable distance, such as down to the beach. Such stands also generally only support the umbrella pole in a vertical direction. A tilting mechanism is commonly provided on cafe umbrellas; however, this feature is often omitted on beach umbrellas.

Another approach generally uses guy wires or ropes, in conjunction with spikes, to support the umbrella. This assumes that the guy ropes can be secured to something or that a spike can be driven into the soil so that a rope may be attached. Not only do several soils, such as beach sand, provide a poor anchor, the guy ropes are inconvenient and create a tripping hazard. The umbrella is also cumbersome to move to another location, such as to adjust it for a change in the angle of the sunshine or in wind.

Some people fill buckets or bags with sand, rocks, or the like in order to make a support. However, one usually has enough to carry when going to the beach or park without additional bags and buckets, and it is usually desirable to spend one's time in pursuits other than filling a bag with sand or rocks. Accordingly, it is desirable to provide an umbrella stand that is not unduly cumbersome to transport or set up. It is further desirable that such a stand would allow for tilting adjustment of a rigid-pole beach umbrella, as well as being able to move the umbrella to a different location with minimal effort.

BRIEF SUMMARY OF THE INVENTION

The present invention provides a cooler, also known as an ice chest, with an integrated receptacle for an umbrella pole.

Persons visiting a beach or park often carry a cooler containing various refreshment, hence in those instances it is not necessary to carry an additional device for supporting an umbrella. In a preferred embodiment, the receptacle has two hinged or folding rings mounted on a side of the cooler. The rings are folded out to allow insertion of the umbrella pole through both rings. When the umbrella pole is removed, the rings may be faded essentially flat with the side of the cooler to allow easy stowage or transportation. The receptacle is molded into the side of the cooler of the same material as the cooler shell, such as polyethylene or other plastic. The combination of a hinge with a ring secures the umbrella pole in the event wind lifts the umbrella, i.e. if the umbrella pole is pulled while allowing the hinge to articulate. The pole is easily removed by holding the ring essentially normal to the pole and sliding the pole out. In an alternate embodiment, a pole lock mechanism is provided. The receptacle allows the end of the pole to be inserted into the soil for further support, if desired. In an alternative embodiment, the receptacle has two rigid rings molded into a recess in the side of the cooler, presenting a flush side for stowage or transportation.

In an another embodiment of the present invention, a conventional cooler is converted to operate as an umbrella stand by the addition of a receptacle to the side of the cooler. The receptacle can be a set of hinged rings, for example, attached to the side of the cooler with a contact adhesive, or with screws or rivets.

DETAILED DESCRIPTION OF THE INVENTION

The present invention provides a cooler that can receive an umbrella pole to support an umbrella, such as a beach umbrella, and a method for converting a conventional cooler to a cooler to operate as an umbrella stand. A cooler is desirable as an umbrella stand for several reasons. First, one often takes a cooler to the beach or park, where an umbrella might be desirable. Therefore, an additional device is not needed to be transported. Second, coolers are often filled with beverages and ice, and therefore often provide a base of substantial stability. Third, the position of the umbrella directly over the cooler increases the likelihood that the cooler will remain in the shade, thus increasing the effectiveness of the cooler to keep items cold. Finally, it is relatively simple to tilt the cooler to adjust the angle of the umbrella, or to move the cooler and umbrella to a new location, compared to an umbrella that is driven into the soil.

Figure 1A:
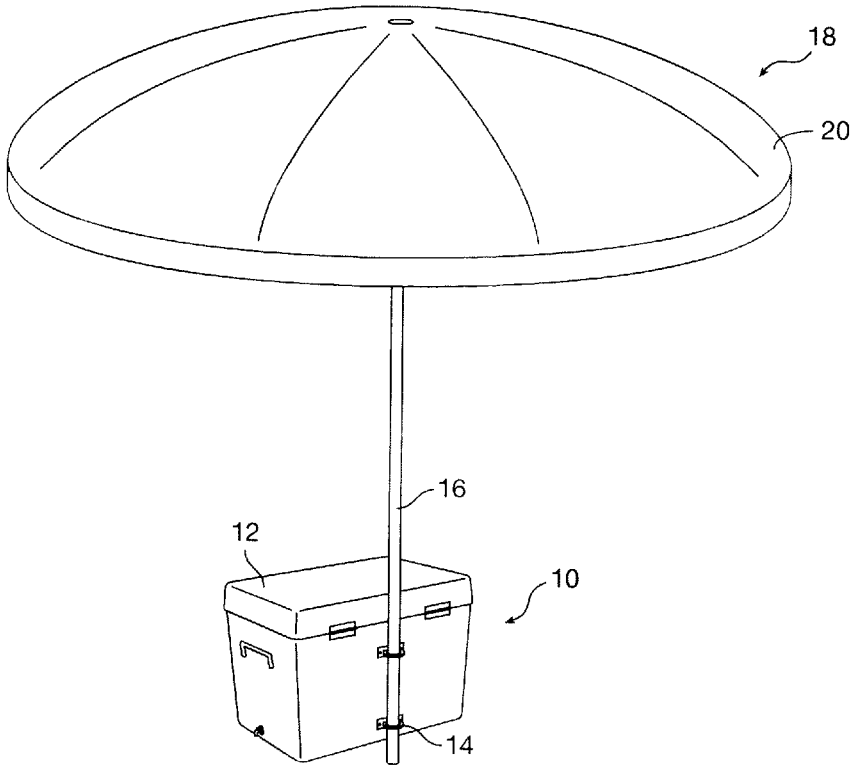
FIG. 1A is a simplified perspective view of a cooler with an integrated umbrella stand and umbrella according to an embodiment of the present invention.
Figure 1B:
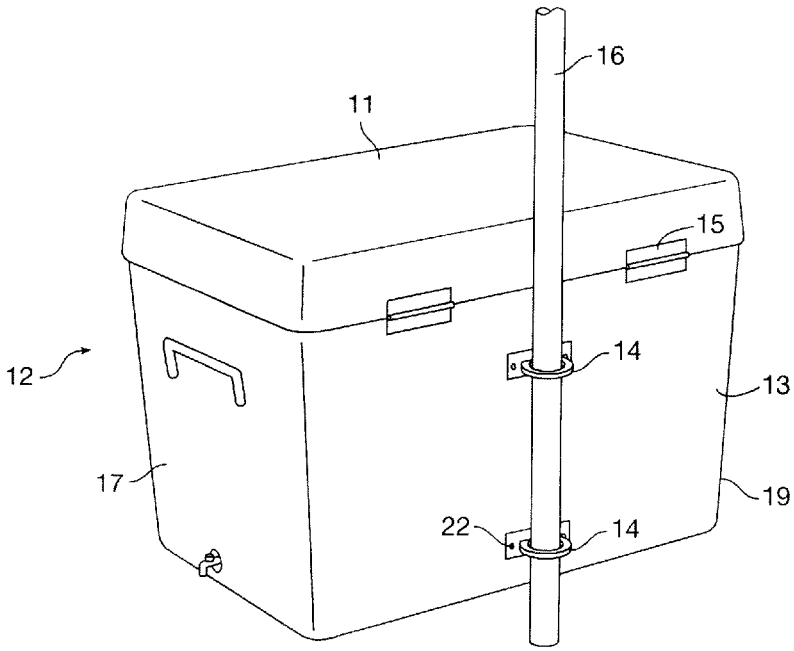
FIG. 1B is a simplified perspective view of a portion of the cooler shown in FIG. 1A.

FIG. 1A is a simplified perspective view of a cooler with integrated umbrella stand 10 according to an embodiment of the present invention. The cooler 12 has rings 14 on the side of the cooler that accept the pole 16 of an umbrella 18. The rings have a substantially round inside diameter to accommodate the pole, typically about 1–1.75 in. (25–44 mm). For ease of discussion, the term "umbrella" will be used herein to describe the combination of the canopy 20 and pole 16 of the umbrella 18. The sides (walls) of the cooler are typically made of plastic, such as polyethylene, polypropylene, or polystyrene, metal, or the like. The rings are made of rubber or plastic and are attached to the side of the cooler with screws 22, with or without adhesive (not shown in this figure). FIG. 1B is a close-up view of a portion of the cooler 12, the rings 14, and the umbrella pole 16. The screws 22 are were sheet-metal type screws with a relatively wide blade and narrow shaft, for securing the rings to the side of the cooler, which is plastic. Alternatively, the rings can be formed, such as by molding, when the cooler is fabricated, or can be attached by adhesive or other means, such as rivets. The umbrella stand is shown on the back 13 of the cooler, roughly centered between the sidewalls 17, 19 of the cooler. Hinges 15 connect the lid 11 of the cooler to the back 13 of the cooler. It is desirable that one is able to open the cooler while supporting an umbrella.

Figure 2A:
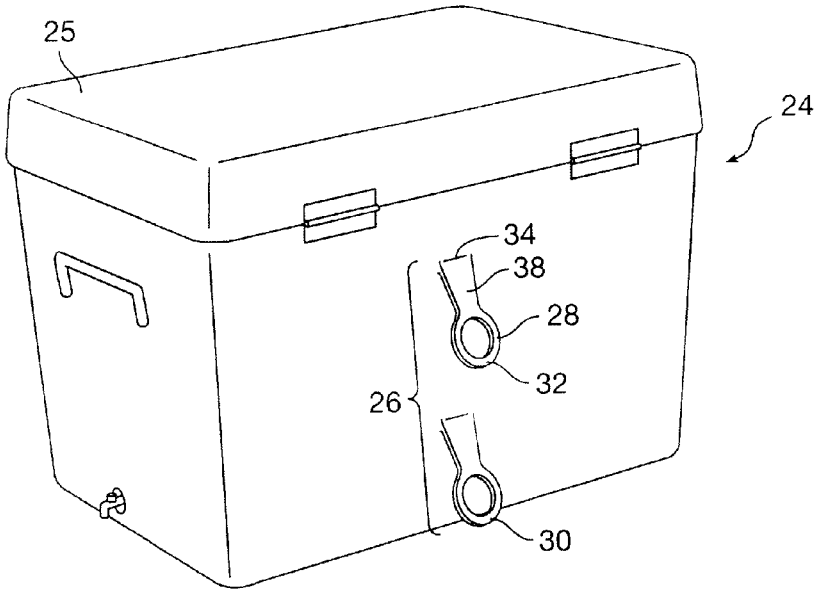
FIG. 2A is a simplified perspective view of a cooler with integrated hinged umbrella stand rings.

FIG. 2A is a simplified perspective view of a cooler with integrated hinged umbrella stand rings. The cooler 24 has been fabricated with an umbrella pole receptacle 26. The receptacle is of the same material as the wall of the cooler and has been molded or attached to the wall of the cooler during the assembly process, such as by thermal or chemical welding, or with adhesive. Alternatively, the receptacle could be formed of a different material than the wall of the cooler. The receptacle is shown in the preferential embodiment as two ring portions 28, 30, allowing for the end of the umbrella pole to contact or be driven into the soil for further stability. Each ring portion includes a ring 32, a throat 38, and a hinge 34. The hinge is formed at the seam between the wall 36 and the throat 38, and can be thinned or scored, if desired, to facilitate bending during use. The throat of the ring portion holds the umbrella pole out from the side of the cooler a distance sufficient to allowing opening the lid 25 of the cooler without the umbrella pole interfering with the lid. The hinge serves at least two functions. First, it lets the receptacle fold essentially flat against the side of the cooler to facilitate transportation or storage of the cooler. It will be appreciated that "essentially flat" means that the receptacle can be folded up or down from its operating position to reduce the distance that the receptacle sticks out from the side of the cooler, and that whether the receptacle is completely flat depends on various design considerations, such as remnant elasticity in the hinge, whether a retaining device is provided to keep the receptacle flat, and whether a recess is provided in the side of the cooler for the receptacle.

Second, the operation of the hinge in cooperation with the ring helps to secure the pole in the receptacle against having the umbrella blow away in the wind, for example. Normally, there is some contact between the pole and the ring. If the pole is lifted, it typically causes the ring to lift with it, and the hinge to rotate. The change in angle between the axis of the pole and the plane of the ring cants the ring with respect to the pole, and portions of the ring impinge on portions of the pole, causing a grabbing effect. The pole is easily removed from the receptacle when desired by either holding the ring normal to the pole while sliding it out, or by manipulating the pole so that the ring(s) do not grab it.

Figure 2B:
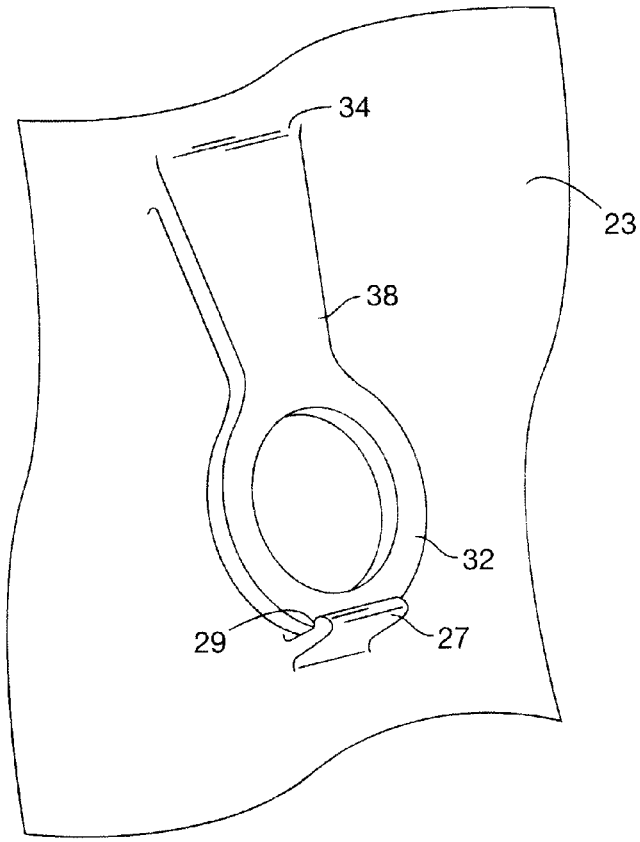
FIG. 2B is a simplified perspective view of a portion of an umbrella receptacle on a cooler wall with a retention device.

FIG. 2B is a simplified perspective view of a portion of a cooler wall 23 with an umbrella ring 32 held down by a retaining device 27. The retaining device has a lip 29 that secures the umbrella ring against the wall of the cooler for transportation or storage. Alternative configurations of retaining devices could be provided, such as a recess in the wall of the cooler that partially overlaps a portion of the umbrella ring.

Figure 3A:
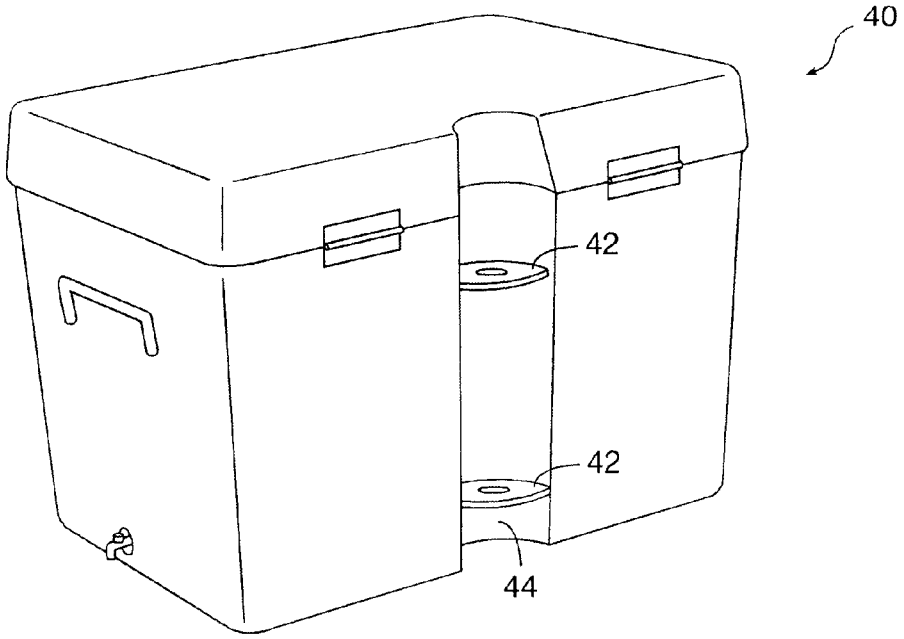
FIGS. 3A and 3B are simplified perspective and side views of a cooler with rigid umbrella stand rings molded into a recess of a side of the cooler.
Figure 3B:
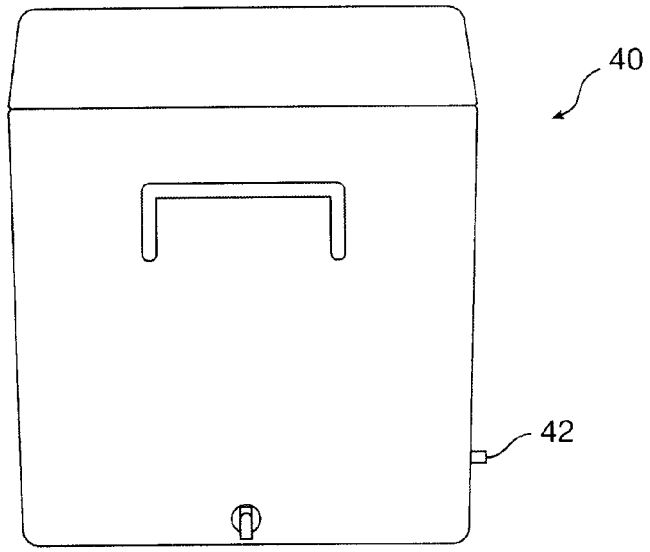

FIG. 3A is a simplified perspective view of a cooler 40 with an alternative embodiment of umbrella stand rings 42 molded into a recess 44 in a side of the cooler. These rings are rigid, i.e. they do not operate in conjunction with a hinge, as do the rings illustrated in FIG. 2A. However, recessing the rings into the side of the cooler maintains a flush profile of the side of the cooler, as shown in the side view of FIG. 3B. The flush profile provides for convenient transportation and storage of the cooler, as when sliding the cooler into or out of a vehicle, for example. However, it is not necessary to fabricate the cooler with the umbrella receptacles, and alternative embodiments of the present invention provide devices for retrofitting existing coolers to perform as umbrella stands, and methods therefore.

Figure 4A:
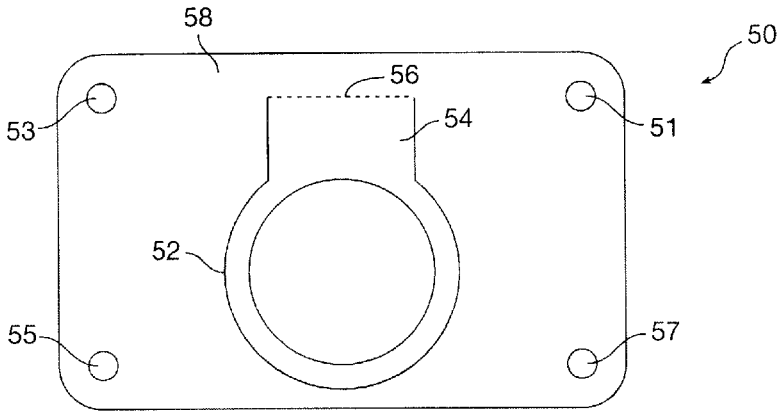
FIGS. 4A–4C are simplified views of umbrella stand rings suitable for attaching to a cooler.

FIG. 4A is a simplified top view of an umbrella ring 50 suitable for attaching to a cooler to convert the cooler into an umbrella stand. The umbrella ring can be attached with fasteners, such as screws, through fastener holes 51, 53, 55, 57. The umbrella ring is preferably rubber or plastic and includes a ring portion 52, a throat portion 54, a hinge portion 56 (represented by a dashed line), and a base portion 58. The hinge portion is generally that region of the umbrella ring that will bend when the ring is raised from the plane of the base. The umbrella ring can be attached to the cooler with adhesive, such as acrylic, urethane, hot-melt, solvent-based, or co-extruded (multi-part) adhesive, or may be attached with fasteners, such as screws or rivets. The adhesive is selected in accordance with the material of the umbrella ring and in anticipation of the material of the cooler wall.

In one embodiment, a sheet of adhesive, such as adhesive foam (i.e. a sheet of poly-urethane foam with appropriate adhesive material(s) on each face of the sheet) about 1–2 mm thick, is applied to a sheet of rubber or plastic, with a peel-off sheet on the free surface of the adhesive sheet. The umbrella ring and associated adhesive is then die cut from the laminated sheets to the shape shown in FIG. 4A. A separate operation removes the adhesive from beneath the ring and throat portion. For example, a first die cutting operation could remove these portions of the adhesive sheet before it is aligned and laminated to the rubber or plastic sheet. Those skilled in the art will recognize other techniques for applying adhesive to the back of the base, such as by spraying adhesive. Alternatively, the umbrella ring could be supplied without the adhesive attached, and a suitably shaped adhesive element to bond the umbrella ring to the cooler could be provided. The peel-off sheet is removed to expose the adhesive surface to be attached to the cooler wall (back). In another embodiment, screws are provided to attach the umbrella ring to,the cooler wall. A preferable screw would be self-drilling, have a narrow shaft, a wide blade, and a broad head, and be fairly short, typically less than about 13 mm (0.5 in.) long.

Figure 4B:
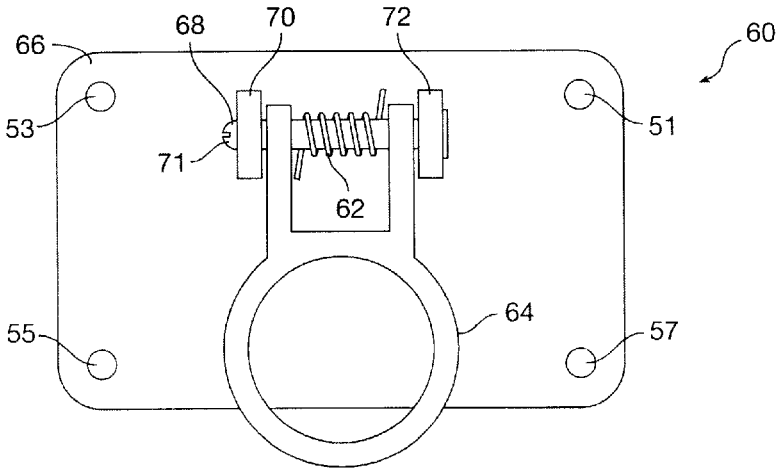

FIG. 4B is a simplified top view of an umbrella ring 60 according to another embodiment of the invention. This umbrella ring includes an optional spring 62 for returning the ring portion 64 to a storage position that is essentially flat against the base 66. The spring 62 is assembled over a hinge pin 68 that is supported by two hinge blocks 70, 72. The base and hinge blocks can be molded in one piece from a suitable polymer, such as acrylonitrile butadiene styrene ("ABS"), polystyrene, or the like. The hinge-pin can be made of metal, such as galvanized steel, or plastic, for example. Alternatively, the base and hinge blocks can be stamped out of a metal sheet, and the hinge blocks bent normal to the base to accept the hinge pin. The hinge pin 68 can be fixed in the hinge blocks 70, 72 by a variety of methods, such as riveting, swaging, or otherwise deforming the end of the hinge pin, or by other means. It is understood that other spring configurations could be used, such as a flat coil spring or leaf spring. The ring portion 64 can be made from the same as the base 66, or a different material(s). For example, the base might be made of ABS while the ring is made of rubber, or vice versa, to facilitate retention of the umbrella pole and provide shock absorption. The umbrella ring may be attached to a cooler as described above in conjunction with FIG. 4A. Additionally, the choice of materials available for making the base might allow a wider selection of fastening methods or adhesives.

In one embodiment, a cooler conversion kit is supplied to a consumer. The cooler conversion kit includes two bases 66 (only one of which is shown) with integrated hinge blocks 70, 72, two ring portions 64 (only one of which is shown), and two snap hinge pins 68 (only one of which is shown), in addition to mounting screws (not shown). Thus, the consumer would assemble components of the conversion kit into base sub-assemblies by inserting the snap hinge pin through the hinge blocks and ring portion. An end 71 of the snap hinge pin slightly deforms when being inserted through the hinge blocks and ring portion and snaps into place when fully inserted. Each base sub-assembly is attached to the cooler using the mounting screws.

Figure 4C:
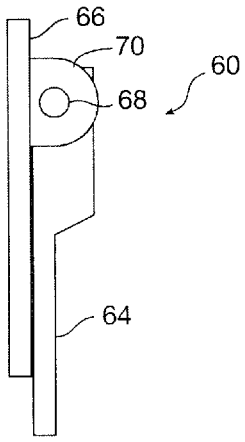

FIG. 4C is a simplified side view of the umbrella ring 60 described in conjunction with FIG. 4B. The ring portion 64 is relieved on the side facing the base (not shown) to allow the ring to swing into position for holding an umbrella pole.

Figure 4D:
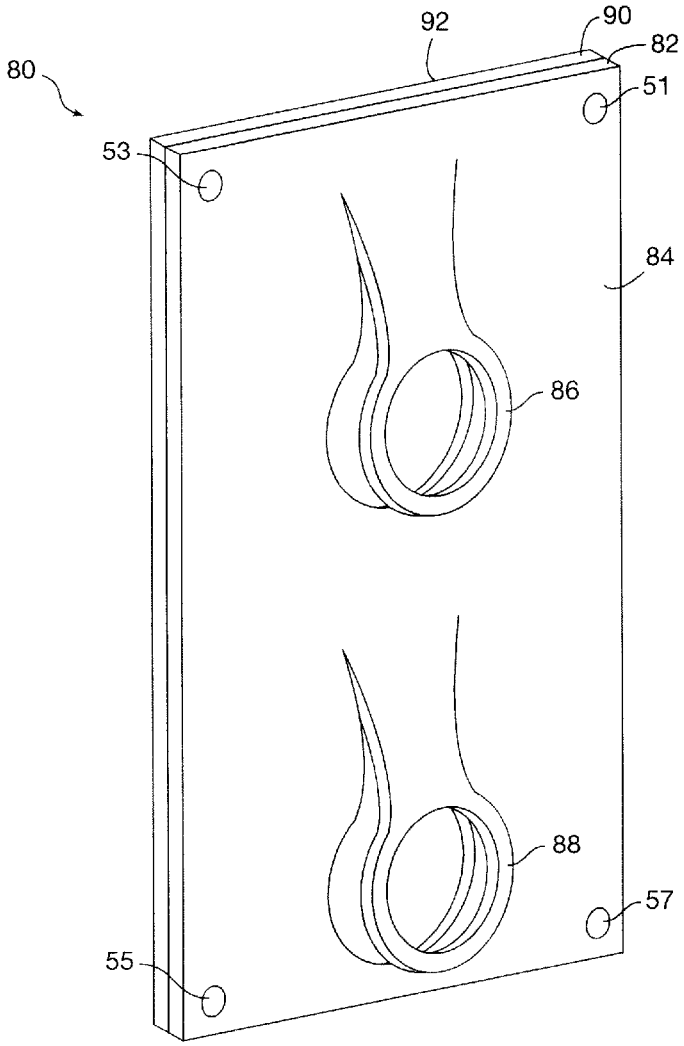
FIG. 4D is a simplified perspective view of a device suitable for attaching to a conventional cooler to provide an umbrella stand.

FIG. 4D is a simplified perspective view of a device 80 suitable for converting a conventional cooler to provide an umbrella stand feature. The device includes an umbrella ring portion 82 that has a base 84 and two umbrella rings 86, 88. The umbrella ring portion is formed out a sheet of rubber or plastic, such as fabric-reinforced laminated synthetic rubber between about 0.1–0.2 in. (2–5 mm) thick, by die cutting. The umbrella rings are shown as being partially folded up for purposes of illustration. The rings can be reinforced with hard plastic, such as a molded or snapped-in-place grommet. A sheet of formed contact adhesive 90 serves as an attachment for attaching the umbrella ring portion to a cooler. The adhesive is acrylic contact adhesive, but could be other types of adhesive. The adhesive sheet includes a protective sheet 92 on the backside that is peeled off to expose a free surface of adhesive for attachment. The adhesive sheet is formed using a separate die cutting process that removes relief areas (not shown) under the umbrella rings before the adhesive sheet is attached to the umbrella ring portion. Alternatively, the adhesive sheet can be provided as a separate piece in a kit, which a person can than attach to umbrella ring portion and the cooler, in a variety of manners. In this instance, the adhesive sheet has a protective sheet on both sides of the adhesive.

The adhesive sheet can include structure between the adhesive surfaces, such as foam or fibers. In a particular embodiment, urethane foam is coated on both sides with acrylic adhesive and pre-applied to a single-piece, two-ring umbrella stand portion. A protective sheet is peeled off the backside of the foam adhesive sheet and the assembly is applied to the side of the cooler. A solvent swab is provided to clean the surface of the cooler and prepare it to accept the adhesive. If further mechanical coupling between the umbrella stand portion and cooler is desired, screws are further provided.

Alternatively, a similar device could provide two separate umbrella ring portions, each with a single ring. However, providing both umbrella rings on a single base has several advantages. First, manufacturing costs are reduced from a reduction in fabrication steps and part counts. Second, the single base has a larger surface area for attachment and adhesive coupling to a cooler wall than would likely be achieved with a two-base device. Finally, providing both rings hinged from a single base allows the rings to be aligned during the manufacturing process, thus avoiding the need for the person applying the device to align the rings, as with a two-base device.

Figure 5:
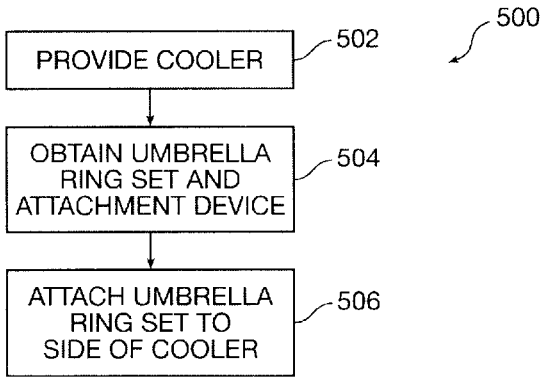
FIG. 5 is a simplified flow chart of a process for converting a conventional cooler to a device according to the present invention.

FIG. 5 is a simplified flow chart of a process 500 for converting a cooler into an umbrella stand. Starting with an existing cooler (step 502), an umbrella ring set is obtained or made (step 504). The umbrella ring set typically includes two hinged umbrella rings and associated bases, as well as attachment means, such as adhesive, adhesive sheet, including double-sided adhesive foam, or screws. In the instances where adhesive is used, the surface of the cooler can be cleaned with alcohol or other solvent to prepare the surface for adhesive bonding. The umbrella ring set is then attached to a side of the cooler (step 506) to accept an umbrella pole. The attachment step typically includes an alignment step (not shown) so that the rings are essentially co-axial when folded to their operating position. Alternatively, the ring set can be provided as a single piece, that is, for example, two rings, throats, and hinge portions formed from a single sheet of plastic that includes a single, common base. The rings are stamped so that they will be co-axial when folded to an operating position. When used with an umbrella, it is generally desirable to fill the cooler with at least about seven pounds of ice, beverages, or similar weight. Additional support can be achieved by planting the lower end of the umbrella pole into the sand or other surface, and/or banking sand, rocks, or other objects around the outer sides of the cooler.

As seen from the above exemplary embodiments, the present invention provides a cooler that can be used as an umbrella stand. While the invention has been thoroughly described above, substitutions, variations, and modifications may be possible without departing from the spirit of the invention. For example, other attachment means or materials may be applicable. For example, a hot glue type of adhesive might be used in a fabrication or retrofitting process, or the device may be deployed on a cooler in a manner other than is shown. Therefore, it is intended that the scope of the invention be determined by the following claims.

What is claimed is:

1. A rectangular cooler configurable to accept an umbrella pole to support an umbrella, the rectangular cooler comprising:

a back wall;

a first sidewall;

a second sidewall;

a first umbrella ring defining a first aperture therethrough, the first umbrella ring being coupled to the back wall with a first hinge, a first throat separating the first ring from the first hinge, the first ring having a first plane, the first hinge allowing the first plane of the first ring to articulate from a first position essentially parallel to the back wall to a second position essentially normal to the back wall, the first umbrella ring being disposed on the back wall essentially equidistant between the first sidewall and the second side wall; and a second umbrella ring defining a second aperture therethrough, the second umbrella ring being coupled to the back wall with a second hinge, a second throat separating the second ring from the second hinge, the second ring having a second plane, the second hinge allowing the second plane of the second ring to articulate from a third position to a fourth position such that the first ring is essentially axially aligned with the second ring when the first ring is in the second position and the second ring is in the fourth position so as to accept the umbrella pole inserted through the first aperture and the second aperture, whereby the umbrella is supported by the rectangular cooler.

2. An umbrella stand device capable of being attached to a cooler and configurable to accept an umbrella pole of an umbrella, the umbrella stand device comprising:

a base a first umbrella ring portion defining a first aperture therethrough attached to the base with a first throat and a first hinge;

a second umbrella ring portion defining a second aperture therethrough attached to the base with a second throat and a second hinge such that the second umbrella ring portion can be configured to be co-axial with the first umbrella ring portion to accept the umbrella pole inserted through the first aperture and the second aperture; and means for attaching the base to the cooler, the cooler providing support to the umbrella when the umbrella pole is inserted through the first aperture and the second aperture, and the umbrella stand device being configurable to fold the first umbrella ring portion and the second umbrella ring portion against the cooler when the umbrella pole is removed from the first aperture and the second aperture.

3. The device of claim 2 wherein the means for attaching comprises an adhesive sheet.

4. The device of claim 3 wherein the adhesive sheet is provided attached to the umbrella ring portion as an assembly, the adhesive sheet further including a peel-off sheet capable of being removed to expose an adhesive surface suitable for attaching the assembly to the cooler.

5. The device of claim 2 wherein the means for attaching comprises a plurality of screws.

6. The device of claim 2 wherein the means for attaching comprises an adhesive sheet in combination with a plurality of screws.

7. The umbrella stand device of claim 2 wherein the first umbrella ring portion has an inside diameter between 1–1.75 inches.

8. A device adapted for attaching to a cooler to provide an umbrella stand feature, the device comprising:

an umbrella ring portion having a rectangular base with four fastener holes, a first hinge coupling a first throat and a first ring defining a first aperture to the base a second hinge coupling a second throat and a second ring defining a second aperture to the base, the first ring having a first plane and a first axis and the second ring having a second plane and a second axis, the device being configurable to slide an umbrella pole through the first aperture and the second aperture when the first axis is co-axial to the second axis and being configurable to fold the first ring and the second ring against the cooler when the umbrella pole is removed from the first aperture and the second aperture; and a plurality of fasteners to attach the base to the cooler through the fastener holes.

9. The device of claim 8 wherein the fasteners comprise screws.

10. A method of providing an umbrella stand feature on a cooler, the method comprising:

providing the cooler;

attaching an umbrella ring set to a wall of the cooler, the umbrella ring set having a first umbrella ring and a second umbrella ring each hinged to a base of the umbrella ring set, the first umbrella ring and the second umbrella ring configured to be aligned in a co-axial fashion to accept an umbrella pole, and to fold against the wall of the cooler when the umbrella pole is removed from the first umbrella ring and the second umbrella ring.

* * * * *